US007008491B2

(12) United States Patent
Woodfield

(10) Patent No.: US 7,008,491 B2
(45) Date of Patent: Mar. 7, 2006

(54) METHOD FOR FABRICATING AN ARTICLE OF AN ALPHA-BETA TITANIUM ALLOY BY FORGING

(75) Inventor: Andrew Philip Woodfield, Madeira, OH (US)

(73) Assignee: General Electric Company, Schenectady, NY (US)

( * ) Notice: Subject to any disclaimer, the term of this patent is extended or adjusted under 35 U.S.C. 154(b) by 308 days.

(21) Appl. No.: 10/293,165

(22) Filed: Nov. 12, 2002

(65) Prior Publication Data

US 2004/0089380 A1 May 13, 2004

(51) Int. Cl.
*C22C 14/00* (2006.01)

(52) U.S. Cl. ..... 148/671

(58) Field of Classification Search ..... 148/671
See application file for complete search history.

(56) References Cited

U.S. PATENT DOCUMENTS

| | | | | |
|---|---|---|---|---|
| 3,481,799 | A * | 12/1969 | Haskell, Jr. et al. | 148/670 |
| 3,963,525 | A | 6/1976 | Bomberger, Jr. et al. | |
| 4,854,977 | A | 8/1989 | Alheritiere et al. | |
| 5,277,718 | A | 1/1994 | Paxson et al. | |
| 5,698,050 | A * | 12/1997 | El-Soudani | 148/671 |
| 5,861,070 | A | 1/1999 | Reichman et al. | |
| 6,233,500 | B1 | 5/2001 | Malas et al. | |
| 6,726,784 | B1 * | 4/2004 | Oyama et al. | 148/421 |
| 2001/0041148 | A1 * | 11/2001 | Oyama et al. | 420/420 |
| 2003/0098099 | A1 * | 5/2003 | Kojima et al. | 148/421 |

FOREIGN PATENT DOCUMENTS

| | | |
|---|---|---|
| EP | 1136582 A | 9/2001 |
| FR | 1527357 A | 5/1968 |
| GB | 2070055 A | 9/1981 |
| WO | WO 98/17836 | 4/1998 |

OTHER PUBLICATIONS

S.L. Semiatin et al., "Hot Working of Titanium Alloys—An Overview", Advances In The Science and Technology of Titanium Alloy Processing (Minerals, Metals & Materials Soc. 1997, pp. 3-73.*

(Continued)

*Primary Examiner*—Daniel Jenkins
(74) *Attorney, Agent, or Firm*—McNees Wallace & Nurick LLC

(57) ABSTRACT

A method for fabricating an article of a titanium-base alloy, such as an alpha-beta titanium gas turbine fan or compressor disk, uses a starting ingot having a thickness of at least about 20 inches, and which is made of a titanium-base alloy having a temperature-composition phase diagram with a beta-phase field and an alpha-beta phase field. The method includes first forging the starting ingot in the beta-phase field to form an in-process billet, thereafter second forging the in-process billet in the alpha-beta phase field, thereafter heating the in-process billet into the beta-phase field to recrystallize the in-process billet, and thereafter third forging the in-process billet. The step of third forging includes forging the in-process billet from a first forging thickness of not less than about 15 inches to a second forging thickness of not more than about 13 inches, at a third-forging temperature of from about 1550° F. to about 1725° F.

21 Claims, 2 Drawing Sheets

OTHER PUBLICATIONS

Metals Handbook, Ninth Edition, vol. 14, "Forming and Forging"(ASM International 1988), p. 268.*

G.A. Salishchev et al., "Fine Grain Billet Processing of Titanium Alloy", Ti '99 Science & Technology (2000), pp. 1563-1568.*

S.P. Fox and D.F. Neal, "The Role of Computer Modelling in the Development of Large Scale Primary Forging of Titanium Alloys". in *Titanium 95*. ed. by P.A. Blekinsop. Institute of Materials, 1995, pp. 628-635.

M.F.X. Gigliotti et al., "Uniform Fine-Grain Processing of α—β Titanium Alloys", Proceedings from the International Conference on Processing and Manufacturing of Advanced Materials "Thermec 2000" held Dec. 4-8, 2000, (From 2001 CD-version).

R. Tricot, "Thermomechanical Processing of Titanium Alloys", Proceedings (Part 1) of the Sixth World Conference on Titanium, Cannes, Jun. 6-9, 1998 (Societe Francaise de Metallurgie), pp. 23-25.

* cited by examiner

METHOD FOR FABRICATING AN ARTICLE OF AN ALPHA-BETA TITANIUM ALLOY BY FORGING

This invention relates to the fabrication by forging of an article made of an alpha-beta titanium alloy and more particularly, to fabricating the article to have a small grain size throughout a large-size forging.

BACKGROUND OF THE INVENTION

In an aircraft gas turbine (jet) engine, air is drawn into the front of the engine, compressed by a shaft-mounted compressor, and mixed with fuel. The mixture is burned, and the hot combustion gases are passed through a turbine mounted on the same shaft. The flow of combustion gas turns the turbine by impingement against an airfoil section of the turbine blades and vanes, which turns the shaft and provides power to the compressor. The hot exhaust gases flow from the back of the engine, driving it and the aircraft forward.

Several critical components of commercial and military gas turbine engines are manufactured from alpha-beta titanium alloys. Examples of such components include fan disks and compressor disks. These components support the respective turbine and compressor blades and rotate at high speeds about their shafts during service of the gas turbine engine.

The fan and compressor disks are typically prepared by melting the titanium alloy of the appropriate composition, casting the titanium alloy as an ingot, and converting the ingot to the billet form. The starting ingot may be as much as 30 inches thick, or more in some circumstances. The billet is mechanically converted by forging to smaller thicknesses and finally forged by closed-die forging to produce the fan or compressor disk in a nearly final form, which is then heat treated and final machined. The fan and compressor disks in their final form may be as large as 40 inches or more in diameter, and as much as 6 inches or more thick, for large-size gas turbine engines.

Some of the important mechanical properties of the large-size forged articles are not as good as those obtained in similarly processed small-size forged or otherwise fabricated articles. For example, in one test the fatigue run-out stress of a 6-inch thick forging is about 23 ksi, and the fatigue run-out stress of a 1.75-inch diameter bar is about 36 ksi. It is therefore necessary to design the large forged article, such as the fan or compressor disk, larger and heavier than would be required if the same fatigue properties achieved in the smaller article could be achieved in the larger article.

The disparity in properties results from the inability to achieve the same fine-scale microstructure throughout the thick forging as is achieved in the smaller bar. That is, the processing of thick articles is qualitatively different from the processing of thinner articles, because of several factors. For example, the center of a thick article cannot be heated as rapidly in an oven or cooled as rapidly in quenching, as can the periphery of the thick article or the entirety of a thin article. The metal flow at the center of the thick article is not as great as that at the periphery of the thick article or throughout the entirety of the thin article. The total amount of reduction is also different for the two sizes. There may be compositional and microstructural gradients through the thick article. Consequently, many of the properties that are readily achieved in thin, essentially uniform articles cannot be achieved in thicker articles.

This problem has long been recognized, and various attempts have been made to improve the properties of thick articles. A surface treatment may be used to improve the properties such as fatigue resistance. The thick article may be fabricated as two or more smaller articles and then joined together. Different alloys may be used in which the thickness-dependence of properties is less. All of these approaches are costly to implement, impossible to apply in some circumstances of limited access and the like, and in some cases introduce their own new problems to be overcome.

There remains a need for an approach to producing thick articles of alpha-beta titanium alloys in which the structures and properties achieved are more nearly like those attained in thin articles. The present invention fulfills this need, and further provides related advantages.

SUMMARY OF THE INVENTION

The present approach provides a fabrication method for thick articles made of alpha-beta titanium alloys, such as fan and compressor disks of large gas turbine engines. This approach achieves a finer, more uniform grain size and a more desirable microstructure in the thick articles, as compared with prior approaches. The mechanical properties of the thick articles are more nearly like those of thin articles of the same composition. The present approach increases the cost of the final article by a relatively small amount.

A method for fabricating an article of a titanium-base alloy includes providing a starting ingot having a thickness of at least about 20 inches, wherein the starting ingot is made of a titanium-base alloy having a temperature-composition phase diagram with a beta-phase field and an alpha-beta phase field. The method includes thereafter first forging the starting ingot in the beta-phase field to form an in-process billet, thereafter second forging the in-process billet in the alpha-beta phase field, thereafter heating the in-process billet into the beta-phase field to recrystallize the in-process billet, and thereafter third forging the in-process billet. The step of third forging includes a step of forging the in-process billet from a first forging thickness of not less than about 15 inches to a second forging thickness of not more than about 13 inches, at a third-forging temperature of from about 1600° F. to about 1700° F. Optionally but preferably, the method includes an additional step, after the step of third forging, of fourth forging, in a closed forging die, the in-process billet to form a semi-finished article, wherein the step of fourth forging is performed at a fourth-forging temperature of from about 1600° F. to about 1700° F.

There is also optionally, but preferably, an additional step, after the step of fourth forging, of heat treating the semi-finished article. The step of heat treating may include a step of solution heat treating the semi-finished article at a solution-heat-treating temperature of from about 1550° F. to about 1725° F., more preferably at the solution-heat-treating temperature of from about 1600° F. to about 1700° F. The step of heat treating may include a step of stress relieving the semi-finished article at a stress-relieving temperature of from about 1000° F. to about 1300° F., after the solution-heat-treating step, if any.

There is optionally but typically an additional step, after the step of heat treating, of machining the semi-finished article. In an application of most interest, the forged semi-finished article has the general shape of a fan or compressor disk, and the semi-finished article is machined to the final configuration and dimensions of the final fan or compressor disk. The semi-finished fan or compressor disk is typically 6 inches thick or more, and 30 inches in diameter or more, for use in a large gas turbine engine.

More specifically in the case of fabricating a gas turbine fan or compessor disk of a titanium-base alloy, there is first provided a generally cylindrical starting ingot having a cylindrical diameter of at least about 30 inches and a cylindrical surface. The starting ingot is made of a titanium-base alloy having a temperature-composition phase diagram with a beta-phase field and an alpha-beta phase field. The fabrication method includes the steps of first forging the starting ingot in the beta-phase field to form a generally cylindrical in-process billet by applying a first-forging primary forging force, thereafter second forging the in-process billet in the alpha-beta phase field by applying a second-forging primary forging force, thereafter heating the in-process billet into the beta-phase field (and optionally working the in-process billet) to recrystallize the in-process billet, optionally quenching the beta-phase worked in-process billet, and thereafter third forging the in-process billet by applying a third-forging primary forging force. The step of third forging includes a step of forging the in-process billet from a first forging thickness of not less than about 15 inches to a second forging thickness of not more than about 13 inches, at a third-forging temperature of from about 1550° F. to about 1725° F. The in-process billet is thereafter sectioned perpendicular to a cylindrical axis of the generally cylindrical in-process billet, to form a "multiple". The method includes upset forging the multiple by applying a primary upsetting force in a direction parallel to the cylindrical axis, to form an upset in-process billet, thereafter fourth forging, in a closed forging die, the upset in-process billet by applying a fourth-forging primary forging force in the direction parallel to the cylindrical axis to form a semi-finished compressor or fan disk, wherein the step of fourth forging is performed at a fourth-forging temperature of from about 1550° F. to about 1725° F., and thereafter heat treating the semi-finished compressor or fan disk. The step of heat treating includes the steps of solution heat treating the semi-finished compressor or fan disk at a solution-heat-treating temperature of from about 1550° F. to about 1725° F., and thereafter stress relieving the semi-finished article at a stress-relieving temperature of from about 1000° F. to about 1300° F. There is typically an additional step, after the step of heat treating, of machining the semi-finished compressor or fan disk. The semi-finished article resulting from the step of fourth forging is desirably a generally cylindrically symmetric, generally disk-shaped article having maximum thickness of at least about 6 inches and a diameter of at least about 30 inches.

The present approach produces a final forged article of uniform fine grain size through a large, thick article. The grain size is typically on the order of about 5 micrometers or less. The result is improved, more uniform mechanical properties throughout the thick article. The resulting mechanical properties approach more closely those of thinner articles. The result is that the thick article may be redesigned and reduced in weight.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
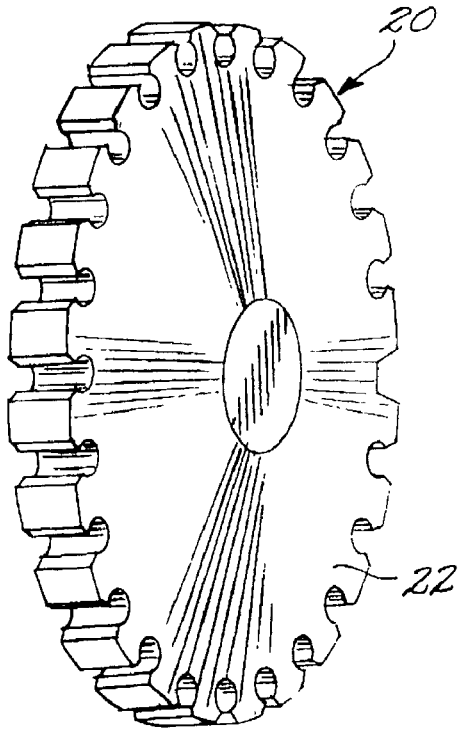
FIG. 1 is a perspective view of a gas turbine fan or compressor disk.

FIG. 1 depicts an article 20 that may be fabricated by the present approach. In this case, the article 20 is a gas turbine disk 22. The illustrated gas turbine disk 22 is a fan disk or a compressor disk. In a typical case of interest, the gas turbine disk is a generally cylindrically symmetric, generally disk-shaped article having a thickness $t_F$ at its thickest point of from about 2 to about 12 inches and a cylindrical diameter $D_F$ of from about 20 to about 50 inches. The present approach is not limited to the fabrication of gas turbine disks, but instead may be used for other operable articles, such as, for example, blisks, shafts, engine mounts, and blades.

Figure 2:
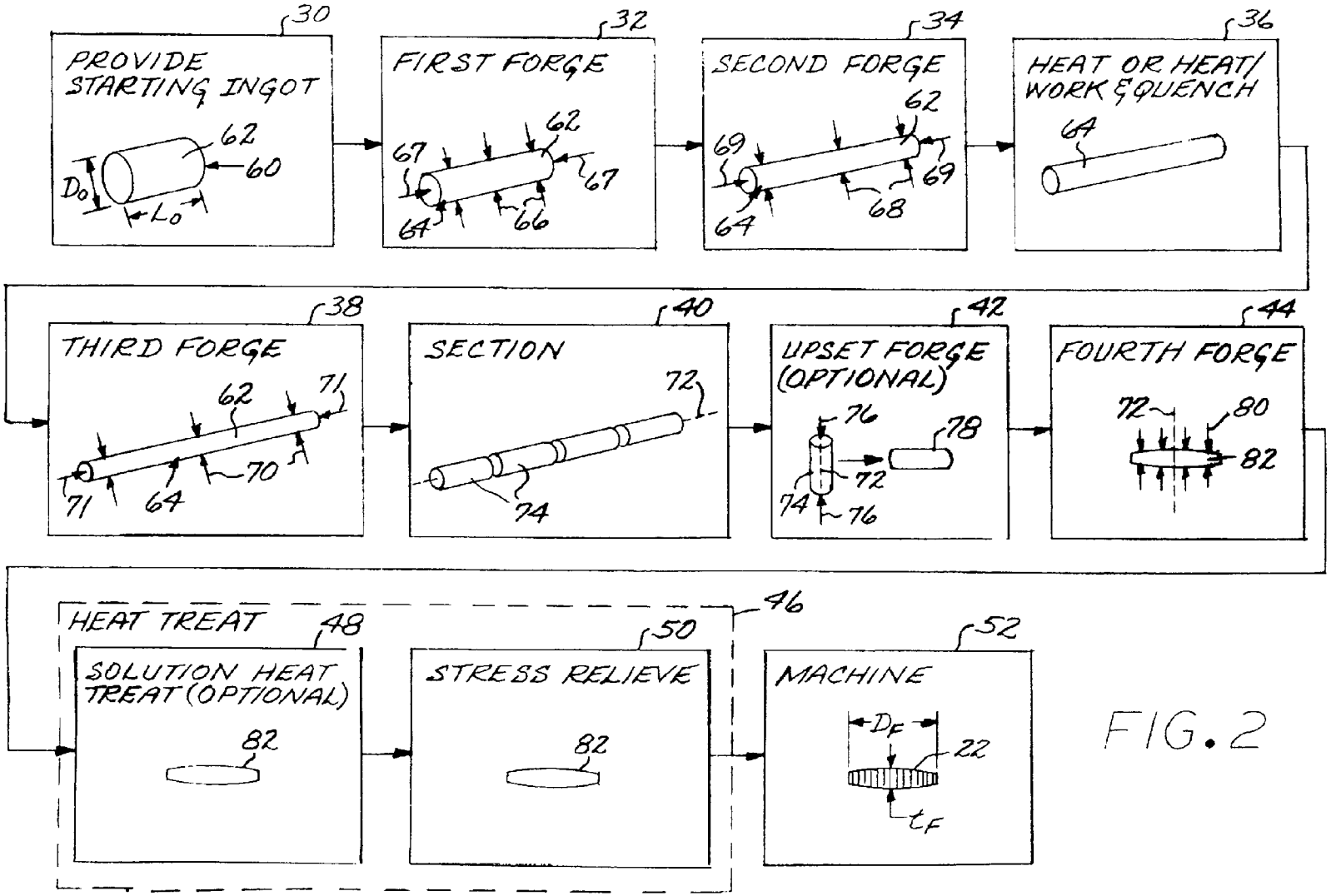
FIG. 2 is a pictorial block flow diagram of a method for fabricating the gas turbine fan or compressor disk.

FIG. 2 illustrates in pictorial form a method for fabricating the gas turbine disk 22 of a titanium-base alloy. The depictions of the billet, semi-finished article, and finished article are specific to the preferred application of the fabrication of the gas turbine disk 22, but the invention is not so limited.

Figure 3:
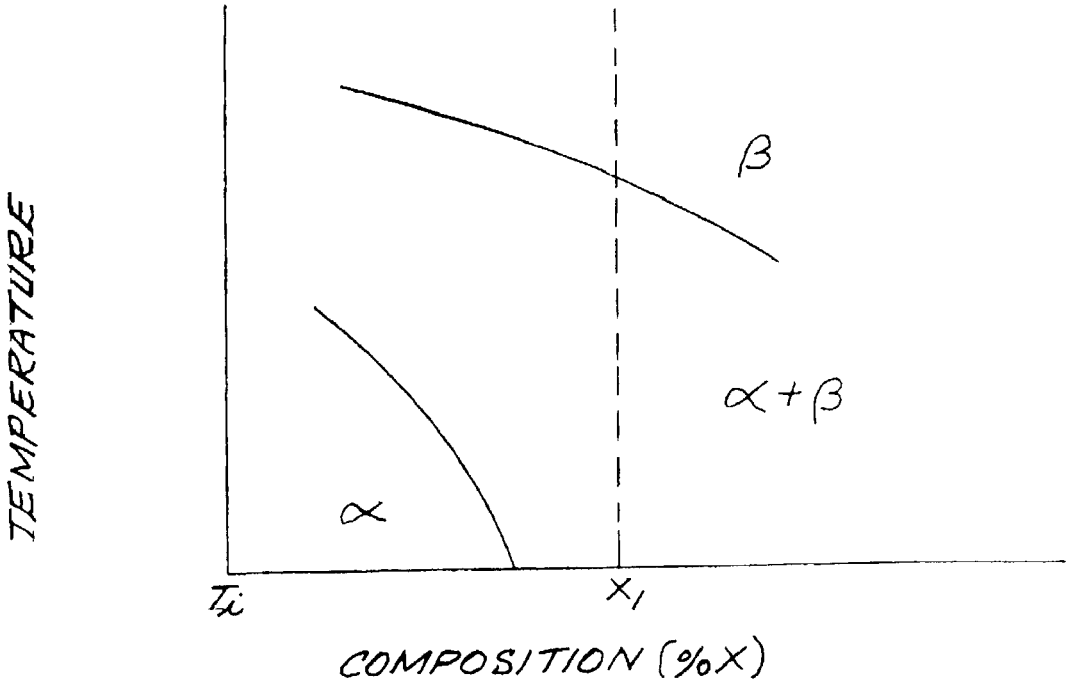
FIG. 3 is a schematic depiction of the relevant portion of the equilibrium phase diagram of the alpha-beta titanium alloy.

A generally cylindrical starting ingot 60, having a length $L_O$ and a cylindrical diameter $D_O$, and having a cylindrical surface 62, is provided, step 30. In the application of interest, $L_O$ is about 120 inches and $D_O$ is about 30 inches. The starting ingot 60 may be provided by any operable process, with casting of a melt of the desired composition being preferred. Titanium alloys are usually final vacuum arc melted and cast. The starting ingot 60 is made of a titanium-base alloy having a temperature-composition phase diagram with a beta-phase field, an alpha-phase field, and an alpha-beta phase field. FIG. 3 illustrates such a phase diagram. (There are many other features to the left and to the right of the indicated region in FIG. 3, but these are not pertinent to the present discussion and are omitted to avoid confusion.) "X" may be any element or combination of elements added to titanium to produce a titanium alloy having such a phase diagram with the alpha ($\alpha$), beta ($\beta$), and alpha-beta ($\alpha+\beta$) phase fields. The line separating the beta phase field from the alpha-beta phase field is termed the beta transus. A specific alloy composition of interest is indicated as composition $X_1$. Examples of titanium-base alloys that exhibit such a phase diagram and their nominal compositions in weight percent include Ti-6Al-4V (sometimes termed Ti-64), Ti-6Al-2Sn-4Zr-2Mo (sometimes termed Ti-6242), and Ti-5Al-4Mo-4Cr-2Sn-2Zr (sometimes termed Ti-17). The present invention may be utilized with any of these alloys, but is not limited to these alloys and may be used with other operable alpha-beta titanium alloys. In the following description, the preferred alpha-beta titanium alloy Ti-6Al-4V will be used as an example for definiteness in respect to temperatures and times, but the invention is not so limited.

The starting ingot 60 is thereafter first forged, step 32, in the beta-phase field to form a generally cylindrical in-process billet 64 by applying a first-forging primary forging force against the cylindrical surface 62 of the generally cylindrical starting ingot 60, as indicated schematically by arrows 66, and/or in a lengthwise fashion against the ends of the starting ingot 60, as indicated schematically by arrows 67. The resulting in-process billet 64 is typically generally cylindrical, but of smaller cylindrical diameter and greater length than the starting ingot 60. For a Ti-6Al-4V starting ingot 60, a typical first-forging temperature for the first-forging step 32 is from about 1900° F. to about 2100° F.

The in-process billet 64 is thereafter second forged, step 34, in the alpha-beta phase field by applying a second-forging primary forging force against the cylindrical surface 62 of the generally cylindrical in-process billet 64, indicated schematically by arrows 68, and/or in a lengthwise fashion, indicated schematically by arrows 69. In the usual case, the in-process billet 64 becomes even longer and of smaller diameter than the in-process billet resulting from step 32. For a Ti-6Al-4V in-process billet 64, a typical second-forging temperature for the second-forging step 34 is about 1750° F.

The in-process billet 64 is thereafter heated, step 36, into the beta-phase field to recrystallize the microstructure of in-process billet 64. The second-forging step 34 had introduced strain into the in-process billet 64, which introduced strain serves as the driving force for the recrystallization. The result of the recrystallization is a reduced grain size that is typically about 0.1 inch in the in-process billet 64, as compared with a grain size on the order of about 1 inch in the starting ingot 60. For a Ti-6Al-4V in-process billet 64, a typical temperature for the heating step 36 is about 1900° F. and a typical time is about 1–2 hours at the center of the billet. The heating step 36 may optionally be accompanied by additional mechanical working in the beta-phase field, such as the application of additional forging force against the cylindrical surface 62, and/or in a lengthwise fashion against the ends of the in-process billet 64. The in-process billet 64 is desirably quenched from the beta-phase field to room temperature at the conclusion of the recrystallization heating step 36.

The in-process billet 64 is thereafter third forged, step 38, by applying a third-forging primary forging force against the cylindrical surface 62 of the generally cylindrical in-process billet 64, indicated schematically by arrows 70, and/or in a lengthwise fashion, indicated schematically by arrows 71. In the usual case, the in-process billet 64 becomes even longer and of smaller diameter than the in-process billet resulting from step 36. The third-forging step 38 includes a step of forging the in-process billet 64 from a first forging thickness (in this case, diameter) of not less than about 15 inches to a second forging thickness (in this case, diameter) of not more than about 13 inches, at a third-forging temperature of from about 1550° F. to about 1725° F., more preferably from about 1600° F. to about 1700° F. In a typical case the in-process billet 64 is forged from a diameter of about 20–25 inches to a diameter of about 10 inches in the third forging 38 in the alpha-beta phase field.

The net result of the forging steps 32, 34, and 38, and the optional working that may be performed in step 36, is to reduce the thickness (cylindrical diameter in the illustrated case) of the starting ingot 60 and the in-process billet 64. However, it may be desirable to introduce more mechanical working into the starting ingot 60 and the in-process billet 64 than is possible during the course of a direct thickness reduction. In that case, the lengthwise reductions represented by arrows 67, 69, and 71 (and discussed for the optional working in step 36) in the respective forging operations may be performed in addition to the reductions in thickness represented by arrows 66, 68, and 70. As an example, the starting ingot 60 may have a diameter $D_O$ and is to be reduced to an in-process billet diameter $D_B$ in step 32. However, this direct reduction from $D_O$ to $D_B$ may not introduce a sufficient amount of mechanical working into the structure of the titanium alloy. To accomplish a greater amount of working, the ingot 60 of diameter $D_O$ may first be lengthwise compressed by the forging force 67 until the diameter is $D_U$ (which is greater than $D_O$), and thereafter reduced by the forging force 66 from the diameter $D_U$ to the desired billet diameter $D_B$. Or, in another example, the entire first-forging step 32 may be lengthwise compression by the forging force 67, and the second forging step 34 may be radial compression by the forging force 68. The determination of these details of the forging sequence is dependent upon a number of factors, such as the dimensions of the starting ingot and the final article, the desired in-process dimensions, and the material and its desired microstructure.

Optionally but desirably, the in-process billet 64 is ultrasonically and/or otherwise inspected after the third forging step 38.

In the specific case of the fabrication of the gas turbine disk 22, the in-process billet 64 is thereafter sectioned, step 40, perpendicular to a cylindrical axis 72 of the generally cylindrical in-process billet 64, to form a group of multiples 74. (A "multiple" is a term of art used to describe each of the sectioned lengths resulting from the sectioning of the in-process billet 64.) Each of the multiples 74 is of the same diameter as the in-process billet 64 prior to sectioning, but of shorter length when measured parallel to the cylindrical axis 72.

The multiple 74 is thereafter optionally upset forged, step 42, by applying a primary upsetting force, indicated schematically by arrow 76, in a direction parallel to the cylindrical axis 72, to form an upset in-process billet 78. The upset forging step 42 is preferably performed at an upset-forging temperature of from about 1550° F. to about 1725° F., more preferably from about 1600° F. to about 1700° F. In a typical case, the multiple 74 is forged from a length of about 50 inches to a length of about 40 inches. The upset forging step 42 is optional both in regard to whether it is performed at all, and also in regard to the number of separate upsetting operations that are performed to achieve an overall desired reduction in length.

The upset in-process billet 74 is thereafter fourth forged, step 44, in a closed forging die, by applying a fourth-forging primary forging force 80 in the direction parallel to the cylindrical axis 72 to form a semi-finished compressor or fan disk 82. The fourth forging step 44 is performed at a fourth-forging temperature of from about 1550° F. to about 1725° F., more preferably from about 1600° F. to about 1700° F. In a typical case, the fourth forging step 44 forges the upset in-process billet 78 to a generally cylindrically symmetric, generally disk-shaped article 82 having a thickness of at least about 6 inches and a diameter of at least about 30 inches.

The permissible temperature ranges of the operations in the various elevated-temperature steps 32, 34, 36, 38, 42, and 44 have been specified. The processing within these ranges may be essential isothermal, as for example heating in a fixed-temperature furnace without associated working, in step 36. More typically in commercial practice with the large pieces employed in the present processing, any forging within these steps is performed with forging dies that are at a lower temperature than the article being forged, and in ambient-temperature air. As a result, the temperature of the workpiece may slowly fall during the forging operation, which is acceptable as long as the temperature remains within the specified range. If the temperature of the workpiece falls below the specified range, it may be taken out of the forging press, placed into a reheat oven, reheated to a higher temperature within the specified range, and then returned to the forging press for additional working.

Cooling of the in-process billet 64 during forging is acceptable. For example, the third forging 38 is accomplished at a third-forging temperature of from about 1550° F. to about 1725° F. However, the third-forging temperature need only be maintained within this temperature range and need not be maintained constant. The third forging 38 may be accomplished, for example, by heating the in-process billet 64 to a third-forging starting temperature toward the higher end of the range, and then performing the forging while the in-process billet 64 is cooling through the third-forging temperature range. If the temperature becomes too low, the in-process billet 64 may be reheated to a temperature within the third-forging temperature range before resuming the third forging 38.

The semi-finished compressor or fan disk 82 is thereafter heat treated, step 46. The heat treating 46 includes an optional solution heat treating step 48 in which the semi-finished article 82 is heated to a solution-heat-treating temperature above the fourth-forging temperature but still within the range of from about 1550° F. to about 1725° F., more preferably from about 1600° F. to about 1700° F., for a time of from about 1 hour to about 4 hours. The heat treating 46 includes a stress relieving step 50 of heating the semi-finished article 82 at a stress-relieving temperature of from about 1000° F. to about 1300° F., for a time of from about 1 to about 8 hours. The heat treatments 46 are usually isothermal and performed in an oven, although it would be permissible for the temperature to fall during the heat treatment as long as it stays within the specified range, as discussed earlier.

The heat treating 46 discussed in the prior paragraph is selected to achieve a particular grain size range in the final article. The heat treating 46 may be altered to achieve other results. For example, if it is instead desired to achieve a different relative volume fraction of the phases, a different grain size, or other different microstructures, the heat treating 46 may be altered accordingly by changing temperatures, times, or sequences of steps.

The semi-finished compressor or fan disk 82 is final machined as necessary, step 52, to form the finished gas turbine disk 22. The order of the steps 46 and 52 may be reversed in whole or in part, with some or all of the machining preceding the heat treatment 46 or being interspersed with the substeps of the heat treatment 46.

The present approach may also be practiced using a consolidated powder starting material rather than a cast ingot. In that case, the consolidated-powder starting material is typically of a finer grain size than that produced by ingot casting. The consolidated-powder starting material may not require the steps 32, 34, and 36, and is instead introduced at step 38.

The present approach produces the article 20, in this case the gas turbine disk 22, that is large in size yet has a uniform, fine grain size. The grain size is preferably on the order of about 5 micrometers for the sizes of articles, such as the compressor or fan disks, discussed here. If the in-process billet is worked further and to a smaller size in the alpha-beta third-forging step 38 and the fourth-forging step 44, as would be the case if the article to be manufactured is a compressor blade, for example, the grain size is expected to be even smaller, on the order of 1 micrometer.

As noted earlier, in general it is more difficult to achieve uniform, well-controlled microstructures with fine microstructural features in thick articles than in thin articles. Processing changes that rely on alterations of heating and cooling rates, and/or alterations of the working operation, therefore have very limited success in achieving such results in large articles, although they may work very well in smaller articles. The present approach overcomes this limitation in large articles, resulting in the desired mechanical and microstructural properties in the large articles.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for fabricating an article of a titanium-base alloy for a gas turbine application, comprising the steps of providing a starting ingot having a thickness of at least about 20 inches, wherein the starting ingot is made of a titanium-base Ti-6Al-4V alloy having a temperature-composition phase diagram with a beta-phase field and an alpha-beta phase field; thereafter first forging the starting ingot in the beta-phase field to form an in-process billet; thereafter second forging the in-process billet in the alpha-beta phase field; thereafter heating the in-process billet into the beta-phase field to recrystallize the in-process billet; and thereafter third forging the in-process billet, wherein the step of third forging includes a step of forging the in-process billet from a first forging thickness of not less than about 15 inches to a second forging thickness of not more than about 13 inches, at a third-forging temperature of from about 1600° F. to about 1700° F. to develop a fine alpha grain size of about 5 micrometers or less.

2. The method of claim 1, wherein the method includes an additional step, after the step of third forging, of fourth forging, in a closed forging die, the in-process billet to form a semi-finished article, wherein the step of fourth forging is performed at a fourth-forging temperature of from about 1550° F. to about 1725° F.

3. The method of claim 2, including an additional step, after the step of fourth forging, of heat treating the semi-finished article.

4. The method of claim 3, wherein the step of heat treating includes a step of solution heat treating the semi-finished article at a solution-heat-treating temperature of from about 1550° F. to about 1725° F.

5. The method of claim 3, wherein the step of heat treating includes a step of stress relieving the semi-finished article at a stress-relieving temperature of from about 1000° F. to about 1300° F.

6. A method for fabricating an article of a titanium-base alloy for a gas turbine application, comprising the steps of providing a starting ingot having a thickness of at least about 20 inches, wherein the starting ingot is made of a titanium-base Ti-6Al-4V alloy having a temperature-composition phase diagram with a beta-phase field and an alpha-beta phase field; thereafter first forging the starting ingot in the beta-phase field to form an in-process billet; thereafter second forging the in-process billet in the alpha-beta phase field; thereafter heating the in-process billet into the beta-phase field to recrystallize the in-process billet; thereafter third forging the in-process billet, wherein the step of third forging includes a step of forging the in-process billet from a first forging thickness of not less than about 15 inches to a second forging thickness of not more than about 13 inches, at a third-forging temperature of from about 1600° F. to about 1700° F. to develop a fine alpha grain size of about 5 micrometers or less; thereafter fourth forging, in a closed forging die, the in-process billet to form a semi-finished article, wherein the step of fourth forging is performed at a fourth-forging temperature of from about 1550° F. to about 1725° F.; and thereafter heat treating the semi-finished article prior to further processing for gas turbine applications.

7. The method of claim 6, wherein the step of heat treating includes a step of solution heat treating the semi-finished article at a solution-heat-treating temperature of from about 1550° F. to about 1725° F.

8. The method of claim 6, wherein the step of heat treating includes a step of solution heat treating the semi-finished article at a solution-heat-treating temperature of from about 1550° F. to about 1725° F. and for a time of from about 1 hour to about 4 hours.

9. The method of claim 6, wherein the step of heat treating includes a step of solution heat treating the semi-finished article at a solution-heat-treating temperature of from about 1600° F. to about 1700° F.

10. The method of claim 6, wherein the step of heat treating includes a step of stress relieving the semi-finished article at a stress-relieving temperature of from about 1000° F. to about 1300° F.

11. The method of claim 6, further including an additional step, after the step of heat treating, of machining the semi-finished article.

12. The method of claim 6, wherein the step of fourth forging includes the step of fourth forging the in-process billet to a shape of a gas turbine disk.

13. A method for fabricating a disk of a titanium-base alloy, comprising the steps of providing a starting ingot having a thickness of at least about 20 inches, wherein the starting ingot is made of a titanium-base Ti-6Al-4V alloy having a temperature-composition phase diagram with a beta-phase field and an alpha-beta phase field; thereafter first forging the starting ingot in the beta-phase field to form an in-process billet; thereafter second forging the in-process billet in the alpha-beta phase field; thereafter heating the in-process billet into the beta-phase field to recrystallize the in-process billet; thereafter third forging the in-process billet to a forged billet, wherein the step of third forging includes a step of forging the in-process billet from a first forging thickness of not less than about 15 inches to a second forging thickness of not more than about 13 inches, at a third-forging temperature of from about 1600° F. to about 1700° F. to develop a fine alpha grain size of about 5 micrometers or less; thereafter fourth forging, in a closed forging die, the in-process billet to form a semi-finished gas turbine disk, wherein the step of fourth forging is performed at a fourth-forging temperature of from about 1550° F. to about 1725° F.; and thereafter heat treating the semi-finished disk, wherein the step of heat treating includes the steps of solution heat treating the semi-finished disk at a solution-heat-treating temperature of from about 1550° F. to about 1725° F., and thereafter stress relieving the semi-finished disk at a stress-relieving temperature of from about 1000° F. to about 1300° F.

14. The method of claim 13, further including an additional step, after the step of heat treating, of machining the semi-finished disk.

15. A method for fabricating a disk of a titanium-base alloy, comprising the steps of providing a generally cylindrical starting ingot having a cylindrical diameter of at least about 30 inches and a cylindrical surface, wherein the starting ingot is made of a titanium-base Ti-6Al-4V alloy having a temperature-composition phase diagram with a beta-phase field and an alpha-beta phase field; thereafter first forging the starting ingot in the beta-phase field to form a generally cylindrical in-process billet by applying a first-forging primary forging force; thereafter second forging the in-process billet in the alpha-beta phase field by applying a second-forging primary forging force; thereafter heating the in-process billet into the beta-phase field to recrystallize the in-process billet; thereafter third forging the in-process billet by applying a third-forging primary forging force, wherein the step of third forging includes a step of forging the in-process billet from a first forging thickness of not less than about 15 inches to a second forging thickness of not more than about 13 inches, at a third-forging temperature of from 1600° F. to about 1700° F. to develop a fine alpha grain size of about 5 micrometers or less; thereafter sectioning the in-process billet perpendicular to a cylindrical axis of the generally cylindrical in-process billet, to form a sectioned in-process billet;

upset forging the sectioned in-process billet by applying a primary upsetting force in a direction parallel to the cylindrical axis, to form an upset in-process billet; thereafter fourth forging, in a closed forging die, the upset in-process billet by applying a fourth-forging primary forging force in the direction parallel to the cylindrical axis to form a semi-finished gas turbine engine disk, wherein the step of fourth forging is performed at a fourth-forging temperature of from about 1550° F. to about 1725° F.; and thereafter heat treating the semi-finished disk, wherein the step of heat treating includes the steps of solution heat treating the semi-finished disk at a solution-heat-treating temperature of from about 1550° F. to about 1725° F., and thereafter stress relieving the semi-finished disk at a stress-relieving temperature of from about 1000° F. to about 1300° F.

16. The method of claim 15, further including an additional step, after the step of heat treating, of machining the semi-finished disk.

17. The method of claim 15, wherein the step of fourth forging includes the step of fourth forging the upset in-process billet to a generally cylindrically symmetric, generally disk-shaped article having a thickness of at least about 6 inches and a diameter of at least about 30 inches.

18. The method of claim 1, wherein the step of third forging includes a step of forging the in-process billet from a first forging thickness of not less than about 15 inches to a second forging thickness of not more than about 13 inches, at a third-forging temperature of from about 1600° F. to about 1700° F.

19. The method of claim 1, further including an additional step, after the step of third forging, of upset forging the in-process billet.

20. The method of claim 6, further including an additional step, after the step of third forging and before the step of fourth forging, of upset forging the in-process billet.

21. The method of claim 13, further including an additional step, after the step of third forging and before the step of fourth forging, of upset forging the in-process billet.

* * * * *